US009515388B2

(12) United States Patent
Chernokalov et al.

(10) Patent No.: US 9,515,388 B2
(45) Date of Patent: Dec. 6, 2016

(54) CONTROLLED LENS ANTENNA APPARATUS AND SYSTEM

(71) Applicant: SAMSUNG ELECTRONICS CO., LTD., Suwon-si (KR)

(72) Inventors: Alexander Guennadievich Chernokalov, Korolev (RU); Artem Yurievich Nikishov, Kolomna (RU); Maria Andreevna Dunaeva, Dolgoprudnyi (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 257 days.

(21) Appl. No.: 14/056,288

(22) Filed: Oct. 17, 2013

(65) Prior Publication Data

US 2014/0104124 A1 Apr. 17, 2014

(30) Foreign Application Priority Data

Oct. 17, 2012 (RU) ..... 2012144224
Oct. 15, 2013 (KR) ..... 10-2013-0122753

(51) Int. Cl.

| | |
|---|---|
| ***H01Q 19/06*** | (2006.01) |
| ***H01Q 15/02*** | (2006.01) |
| ***H01Q 15/08*** | (2006.01) |
| ***H01Q 3/24*** | (2006.01) |

(52) U.S. Cl.

CPC ..... *H01Q 15/02* (2013.01); *H01Q 3/245* (2013.01); *H01Q 15/08* (2013.01); *H01Q 19/062* (2013.01)

(58) Field of Classification Search

CPC ..... H01Q 3/46
USPC ..... 343/753–754
See application file for complete search history.

(56) References Cited

U.S. PATENT DOCUMENTS

| | | | | |
|---|---|---|---|---|
| 4,706,094 | A * | 11/1987 | Kubick | H01Q 3/44 343/753 |
| 5,825,554 | A * | 10/1998 | Maier | G02B 3/0087 359/652 |
| 6,400,328 | B1 * | 6/2002 | Falk | H01Q 3/44 343/754 |
| 2003/0214457 | A1 | 11/2003 | Ishikawa et al. | |

(Continued)

FOREIGN PATENT DOCUMENTS

| | | | |
|---|---|---|---|
| JP | 2007-104027 | A | 4/2007 |
| JP | 2010-063051 | A | 3/2010 |
| KR | 1994-7001589 | A | 5/1994 |

OTHER PUBLICATIONS

Filipovic et al. ("Off-Axis Properties of Silicon and Quartz Dielectric Lens Antennas" IEEE Transactions on Antennas and Propagation, vol. 45, No. 5, May 1997).*

*Primary Examiner* — Dameon E Levi
*Assistant Examiner* — Ricardo Magallanes
(74) *Attorney, Agent, or Firm* — NSIP Law

(57) ABSTRACT

Present configuration concerns microelectronics; for instance, compact antenna devices applied in mobile communications and other equipment operating in millimeter range. The controlled lens antenna apparatus may include antenna elements in an integrated circuit configured to transmit beams. The apparatus may also include a dielectric lens antenna configured to generate a plane wave based in the beams transmitted. The apparatus may include a plate configured to deflect the generated plane wave at a random angle.

16 Claims, 6 Drawing Sheets

(56) References Cited

U.S. PATENT DOCUMENTS

| | | | | |
|---|---|---|---|---|
| 2008/0284655 | A1* | 11/2008 | Alamouti | H01Q 1/38 343/700 MS |
| 2009/0262038 | A1* | 10/2009 | Gerding | G01F 23/284 343/783 |
| 2012/0306708 | A1 | 12/2012 | Henderson et al. | |

* cited by examiner

CONTROLLED LENS ANTENNA APPARATUS AND SYSTEM

CROSS-REFERENCE TO RELATED APPLICATION(S)

This application claims the benefit under 35 U.S.C. §119 (a) of Russian Patent Application No. 2012-144224, filed on Oct. 17, 2012, in the Russian Intellectual Property Office, and Korean Patent Application No. 10-2013-0122753 filed on Oct. 15, 2013, in the Korean Intellectual Property Office, the entire disclosures of which are incorporated herein by reference for all purposes.

BACKGROUND

1. Field

The following description relates to a compact and controlled lens antenna to enable continuous directivity variation in a mobile communication equipment operating in a millimeter range.

2. Description of Related Art

In a development and manufacturing of semi-conductor integrated circuits (IC), one of the many focuses in recent years has been to reduce a size of the IC by reducing in size while increasing a number components being integrated in the IC, thereby increasing a package density of the IC and providing a maximum operating frequency. Production of high-frequency broad-band ICs both for commercial use and for the consumer electronic equipment became economically justified with the appearance of silicon ICs having a large functionality on higher frequencies at smaller dimensions and at lower cost. High-frequency broad-band elements based on IC are applied now in the communicators working on small distances in a millimeter range of an order of 24 GHz-60 GHz, and in the automobile radar working in a range of 24 GHz-77 GHz. These elements are appealing because they are designed to operate at or near "millimeter-wave" frequencies (3 to 300 gigahertz). Cellular networks have always occupied bands lower on the spectrum, where carrier waves tens of centimeters long (hundreds of megahertz) pass easily around obstacles and through the air. But this spectrum is heavily used, making it difficult for operators to acquire more of it. Presently, operating frequencies of commercial communications and radar applications have reached an upper range limit of radio band, having extended to millimeter waves.

Ultra-compact antennas have been developed based on IC to operate in millimeter range. However, one of the many drawbacks of existing ultra-compact antennas is that they allow executing only discrete switching of directivity. For smooth scanning in known solutions the increasing of number of antennas on IC is required that leads to increasing of the dimensions of IC, thereby producing a larger and more expensive IC.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative example, there is provided a In accordance with an illustrative example, there is provided a controlled lens antenna apparatus, including antenna elements in an integrated circuit configured to transmit beams; a dielectric lens antenna configured to generate a plane wave based in the beams transmitted; and a plate configured to deflect the generated plane wave at a random angle.

A dielectric lens of the dielectric lens antenna may include a hemispherical part and a cylindrical continuation and is formed of a dielectric substance.

The antenna elements may be located on a plane surface of a cylindrical continuation of a dielectric lens of the dielectric lens.

The dielectric lens antenna may be homogeneous or composite.

The dielectric lens antenna may includes a dielectric lens body with relative dielectric conductivity $\in_1$, a dielectric lens fill piece with relative dielectric conductivity $\in_2$, where $\in_1<\in_2$, and a matching dielectric lens covering with relative dielectric conductivity $\in_3$, where $\in_3=\sqrt{\in_2}$.

The controlled lens antenna apparatus may be formed on a high-resistance semi-conductive substrate.

The dielectric lens antenna may include a dielectric lens body and a dielectric lens fill piece.

The dielectric lens body may include a relative dielectric conductivity $\in_1$ and the dielectric lens fill piece is a hyperboloid fill piece with relative dielectric conductivity $\in_2$.

A dependence of relative dielectric conductivities $\in_1$ and $\in_2$ of the dielectric lens antenna may include $\in_2=\in_1(1+\mathrm{tg}(\phi/2))$, where $\phi$ is an angle between hyperboloid axes.

The plate may include a ceramic plate with a dielectric conductivity changed through an applied voltage, two matching plates, and contact electrodes.

A deviation angle of the plate may be determined through arcsin(d/s), where d is a propagation difference, S is a distance between centers of contact electrodes of the plate.

The plate may include ferroelectric ceramic plates and corresponding layers.

In accordance with another illustrative example, there is provided controlled lens antenna apparatus, including antenna elements in an integrated circuit configured to transmit beams; a dielectric lens antenna configured to generate a plane wave based in the beams transmitted, wherein a lens of the dielectric lens antenna includes a hemispherical part with a predetermined radius and a cylindrical continuation having a predetermined length; and a deflecting plate including contact electrodes and configured to deflect the generated plane wave at a random angle using a relationship between a propagation difference of the beams and a distance between centers of the contact electrodes.

The antenna elements may be located on a plane surface of the cylindrical continuation.

The dielectric lens antenna may be homogeneous or composite.

The dielectric lens antenna may include a dielectric lens body with relative dielectric conductivity $\in_1$, a dielectric lens fill piece with relative dielectric conductivity $\in_2$, where $\in_1<\in_2$, and a matching dielectric lens covering with relative dielectric conductivity $\in_3$ where $\in_3=\sqrt{\in_2}$.

The dielectric lens antenna may include a dielectric lens body and a dielectric lens fill piece, The dielectric lens body may include a relative dielectric conductivity $\in_1$ and the dielectric lens fill piece is a hyperboloid fill piece with relative dielectric conductivity $\in_2$.

A dependence of relative dielectric conductivities $\in_1$ and $\in_2$ of the dielectric lens antenna may include $\in_2=\in_1(1+\mathrm{tg}(\phi/2))$, where $\phi$ is an angle between hyperboloid axes.

The deflecting plate may also include a ceramic plate with a dielectric conductivity changed through an applied voltage, two matching plates, and contact electrodes of the deflecting plate.

A deviation angle of the deflecting plate may be determined through arcsin(d/s), where d is a propagation difference, S is a distance between centers of contact electrodes.

The deflecting plate may include ferroelectric ceramic plates and corresponding layers.

Other features and aspects will be apparent from the following detailed description, the drawings, and the claims.

Figure 1:
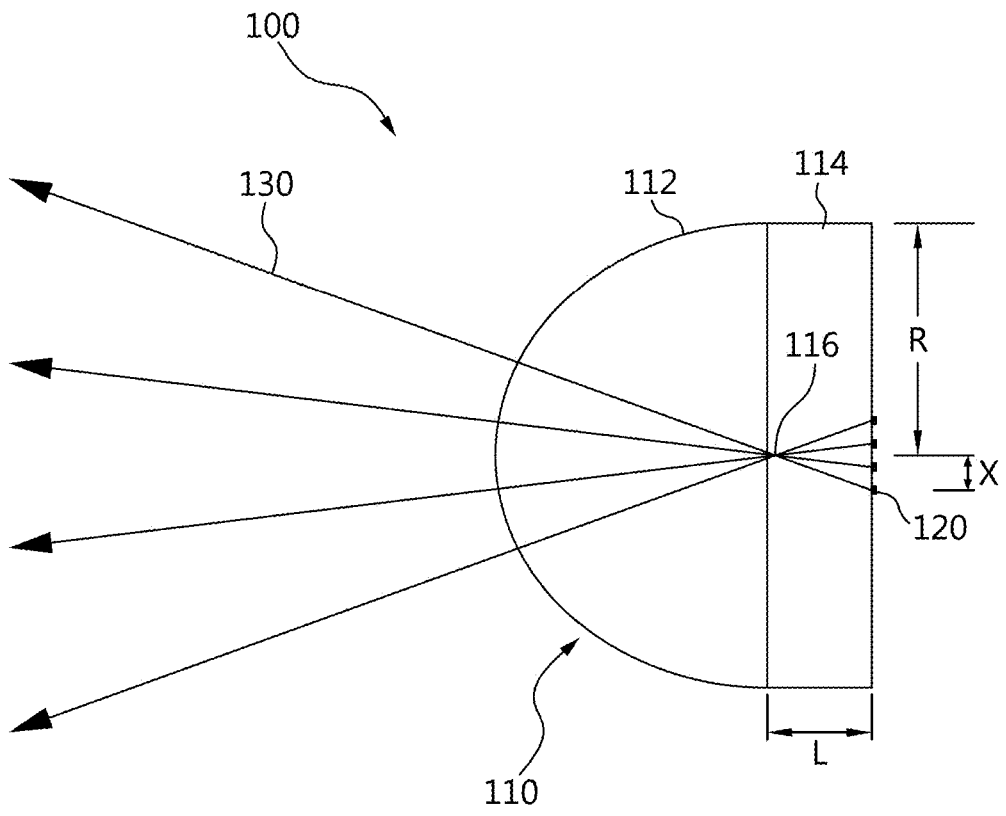
FIG. 1 is a diagram illustrating an example of a scanning or a controlled lens antenna of a compact lens apparatus, in accordance with an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, description of well-known functions and constructions may be omitted for increased clarity and conciseness.

In accordance with an illustrative configuration, a compact lens antenna apparatus is presented enabling a smooth directivity variation without increasing dimensions and manufacturing costs of an integrated circuit (IC). In one example, the compact lens apparatus may be used as a part of millimeter range systems, such as wireless data transmission systems and automobile radars enabling designing compact controlled lens antenna systems with low frequency requirements.

The compact lens antenna apparatus includes antenna elements in an IC and a dielectric lens antenna configured to generate a plane wave. The antenna elements may be configured to transmit beams. The compact lens antenna apparatus also includes a plate configured to deflect the generated plane wave at a random angle. The plate may be a deflecting plate.

FIG. 1 is a diagram illustrating an example of a scanning or a controlled lens antenna of the compact lens apparatus, in accordance with an embodiment.

In one illustrative example, FIG. 1 illustrates a scheme of the scanning or controlled lens antenna 100. In one example, the controlled lens antenna may be used in visualization systems. The controlled lens antenna 100 includes a lens 110 and antenna elements 120. The lens 110 includes a hemispherical part 112, having a radius R, and a cylindrical continuation 114, having length L. In one example, the lens 110 is formed of a dielectric substance. The antenna elements 120 are located on a plane surface of the cylindrical continuation 114. Each antenna element 120 transmits signals as corresponding beams 130. An angular direction of each beam 130 corresponds to a shift, a distance, or a displacement, X, of each corresponding the antenna element 120 from a focus point 116 of lens 110. Scanning is provided by displacing each of the antenna elements 120 in accord with a transmission requirement of an external circuit. In one example, the external circuit can be used for video transmission from each element of the antenna elements 120.

Figure 2:
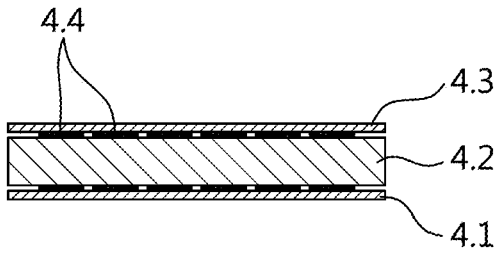
FIG. 2 is a diagram illustrating an example of the controlled lens antenna, in accordance with an embodiment.
Figure 2:
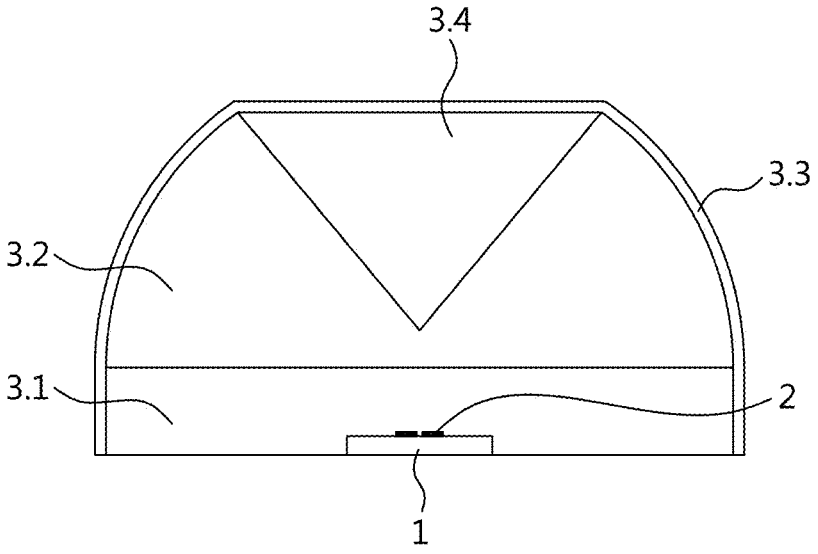

FIG. 2 is a diagram illustrating an example of a controlled lens antenna, in accordance with an embodiment.

The controlled lens antenna of FIG. 2 includes an integrated circuit (IC) 1, antenna elements 2 on the IC 1, a dielectric lens antenna 3.1-3.4, and a deflecting plate 4.1-4.4. The controlled lens antenna including the antenna elements 2 on the IC 1 and the dielectric lens antenna 3.1-3.4 generates a plane wave. In one example, the dielectric lens antenna 3.1-3.4 is homogeneous or composite. The dielectric lens antenna 3.1-3.4 includes a dielectric lens body 3.1, 3.2 with relative dielectric conductivity $\in_1$ and a dielectric lens fill piece 3.4 with relative dielectric conductivity $\in_2$ ($\in_1<\in_2$). The dielectric lens antenna 3.1-3.4 can also have a matching dielectric lens covering 3.3. The relative dielectric conductivity may be relative permittivity.

Figure 3:
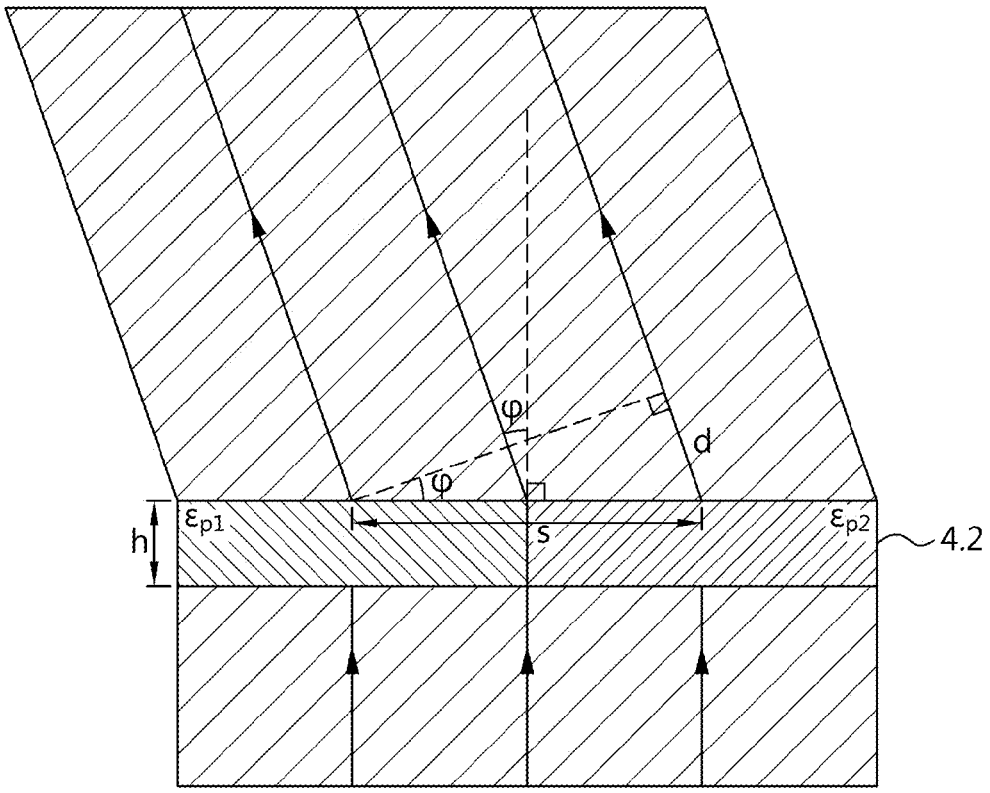
FIG. 3 is a diagram illustrating a deviation angle of the controlled lens antenna, in accordance with an embodiment.
Figure 5A:
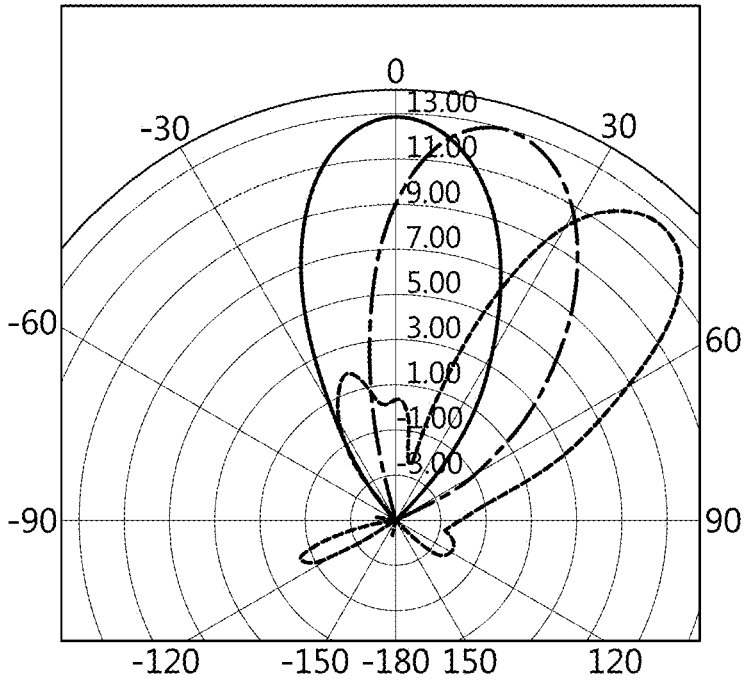
FIGS. 5A and 5B is a diagram illustrating a radiation pattern of the controlled lens antenna, in accordance with an embodiment.
Figure 5B:
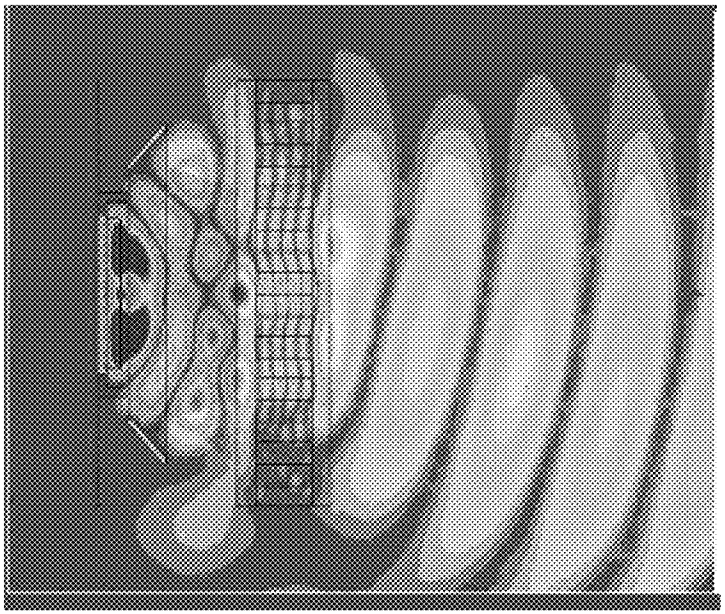

The plane wave generated by the dielectric lens antenna 3.1-3.4 is deflected by a deflecting plate 4.1-4.4. The deflecting plate 4.1-4.4 includes, for example, a ceramic plate 4.2, two matching plates 4.1, 4.3, and contact electrodes 4.4. A dielectric conductivity of the ceramic plate 4.2 may be changed through a predetermined applied voltage. The dielectric conductivity may be permittivity. The predetermined applied voltage may be a voltage applied to the ceramic plate 4.2 by the contact electrodes 4.4. The deflecting plate may be configured to deflect the generated plane wave at a random angle using a relationship between a propagation difference of the beams and a distance between centers of the contact electrodes. A deviation angle of the deflecting plate 4.1-4.4 may be determined using the following relationship arcsin(d/s), where d is a propagation difference of the beams, S is a distance between centers of contact electrodes. FIG. 3 is a diagram illustrating a deviation angle of the controlled lens antenna, in accordance with an embodiment. Thus, the deviation angle can be expressed as:

$$\varphi = \arcsin\left(\frac{h(\sqrt{\varepsilon_{p1}} - \sqrt{\varepsilon_{p2}})}{s}\right),$$

where $\phi$ may be the deviation angle, h is a thickness of the ceramic plate 4.2, $\in_{p1}$ and $\in_{p2}$ are relative dielectric conductivities of various parts of the ceramic plate 4.2 under an influence of a various voltages. s may be a distance between centers of the contact electrodes. FIGS. 5A and 5B are diagrams illustrating a radiation pattern of the controlled lens antenna, in accordance with an embodiment.

Figure 4:
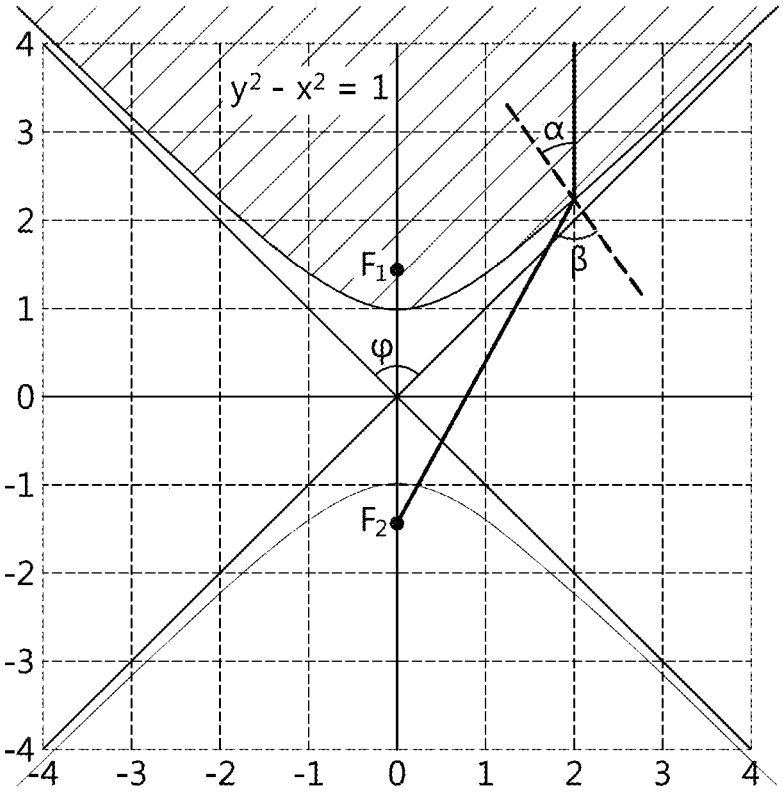
FIG. 4 is a diagram illustrating a source of waves in hyperboloid focus, in accordance with an embodiment.

In accordance with an illustrative example, the controlled lens antenna apparatus on an IC can be formed on a high-resistance semi-conductive substrate. The dielectric lens antenna 3.1-3.4 may include the dielectric lens body 3.1, 3.2 with relative dielectric conductivity $\in_1$ and a dielectric lens fill piece. The dielectric lens fill piece may be hyperboloid fill piece 3.4 with relative dielectric conductivity $\in_2$. The hyperbolic fill piece 3.4 configured to enable a considerable reduction in dimensions of the controlled lens antenna apparatus. In one example, to transform a spherical wave to a plane wave, a source of waves is placed in hyperboloid focus (see FIG. 4). In FIG. 4, $F_1$ and $F_2$ indicate focuses of hyperboloids. x and y indicate coordinate values of points forming the hyperboloids. A wave from the focus $F_2$ of one of the hyperboloids may be deflected at an angle of $\beta-\alpha$ at a point of the other hyperboloid. A dashed line in FIG. 4 may be a perpendicular line at the point of the hyperboloid. A dependence of relative dielectric conductivities $\in_1$ and $\in_2$ of the dielectric lens antenna 3.1-3.4 may be expressed by the following relation:

$$\in_2=\in_1(1+tg(\phi/2)).$$

where $\phi$ is an angle between hyperboloid axes. tg may be the tangent function. Thus, in case $\phi=90°$, $\in_2=2\in_1$. If to consider dielectric losses, the following relation may apply: $\in_2<2\in_1$, $\in_1<\in_2<2\in_1$.

The dielectric lens antenna 3.1-3.4 may also have a matching dielectric lens covering 3.3 with relative dielectric conductivity $\in_3$.

$$\in_3=\sqrt{\in_2}$$

In accordance with an alternative configuration, the deflecting plate 4.1-4.4 can include ferroelectric ceramic plates and matching or corresponding layers. The dielectric conductivity of ferroelectric ceramic plates would be regulated by an applied voltage.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A controlled lens antenna apparatus, comprising:

antenna elements in an integrated circuit configured to transmit beams;

a dielectric lens antenna configured to generate a plane wave based in the beams transmitted; and a plate configured to deflect the generated plane wave at a random angle and the dielectric lens antenna comprises:

a dielectric lens body with a first relative dielectric conductivity;

a dielectric lens fill piece with a second relative dielectric conductivity, the dielectric lens fill piece being a hyperboloid fill piece; and a matching dielectric lens covering with a third relative dielectric conductivity; and wherein the second relative dielectric conductivity is larger than the first relative dielectric conductivity and is determined based on the first relative dielectric conductivity and an angle between hyperboloid axes of the hyperboloid fill piece, wherein the third relative dielectric conductivity is determined based on the second relative dielectric conductivity, and wherein a source of waves is placed in hyperboloid focus of the hyperboloid fill piece.

2. The apparatus as recited in claim 1, wherein a dielectric lens of the dielectric lens antenna comprises a hemispherical part and a cylindrical continuation and is formed of a dielectric substance.

3. The apparatus as recited in claim 1, wherein the antenna elements are located on a plane surface of a cylindrical continuation of a dielectric lens of the dielectric lens antenna.

4. The apparatus as recited in claim 1, wherein the dielectric lens antenna is homogeneous or composite.

5. The apparatus as recited in claim 1, wherein the controlled lens antenna apparatus is formed on a high-resistance semi-conductive substrate.

6. The apparatus as recited in claim 1, wherein the dielectric lens body comprises a relative dielectric conductivity $\in_1$ and the dielectric lens fill piece is the hyperboloid fill piece with relative dielectric conductivity $\in_2$.

7. The apparatus as recited in claim 1, wherein a dependence of relative dielectric conductivities $\in_1$ and $\in_2$ of the dielectric lens antenna comprises $\in_2=\in_1(1+tg(\phi/2))$, where $\phi$ is the angle between hyperboloid axes.

8. The apparatus as recited in claim 1, wherein a deviation angle of the plate is determined through arcsin(d/s), where d is a propagation difference, s is a distance between centers of contact electrodes of the plate.

9. The apparatus as recited in claim 1, wherein the plate comprises ferroelectric ceramic plates and corresponding layers.

10. A controlled lens antenna apparatus, comprising:

antenna elements in an integrated circuit configured to transmit beams;

a dielectric lens antenna configured to generate a plane wave based in the beams transmitted, wherein a lens of the dielectric lens antenna comprises a hemispherical part with a predetermined radius and a cylindrical continuation having a predetermined length; and a deflecting plate comprising contact electrodes and configured to deflect the generated plane wave at a random angle using a relationship between a propagation difference of the beams and a distance between centers of the contact electrodes, and the dielectric lens antenna comprises:

a dielectric lens body with a first relative dielectric conductivity;

a dielectric lens fill piece with a second relative dielectric conductivity; and a matching dielectric lens covering with a third relative dielectric conductivity; and wherein the second relative dielectric conductivity is larger than the first relative dielectric conductivity and is determined based on the first relative dielectric conductivity and an angle between hyperboloid axes of the hyperboloid fill piece, wherein, the third relative dielectric conductivity is determined based on the second relative dielectric conductivity, and wherein a source of waves is placed in hyperboloid focus of the hyperboloid fill piece.

11. The apparatus as recited in claim 10, wherein the antenna elements are located on a plane surface of the cylindrical continuation.

12. The apparatus as recited in claim 10, wherein the dielectric lens antenna is homogeneous or composite.

13. The apparatus as recited in claim 10, wherein the dielectric lens body comprises a relative dielectric conductivity $\in_1$ and the dielectric lens fill piece is the hyperboloid fill piece with relative dielectric conductivity $\in_2$.

14. The apparatus as recited in claim 10, wherein a dependence of relative dielectric conductivities $\in_1$ and $\in_2$ of the dielectric lens antenna comprises $\in_2=\in_1(1+\mathrm{tg}(\phi/2))$, where $\phi$ is the angle between hyperboloid axes.

15. The apparatus as recited in claim 10, wherein a deviation angle of the deflecting plate is determined through arcsin(d/s), where d is a propagation difference, s is a distance between centers of contact electrodes of the deflecting plate.

16. The apparatus as recited in claim 10, wherein the deflecting plate comprises ferroelectric ceramic plates and corresponding layers.

* * * * *